United States Patent [19]

Schopper

[11] 4,272,867

[45] Jun. 16, 1981

[54] APPARATUS FOR LOADING A ROPE-LIKE STRAND OF FIBERS INTO SPINNING CANS

[75] Inventor: Alf Schopper, Meyrin, Switzerland

[73] Assignee: Heberlein Hispano S.A., Switzerland

[21] Appl. No.: 88,814

[22] Filed: Oct. 29, 1979

[30] Foreign Application Priority Data

Oct. 30, 1978 [CH] Switzerland ..... 11190/78

[51] Int. Cl.[3] ..... B65H 54/80

[52] U.S. Cl. ..... 19/159 R

[58] Field of Search ..... 19/159 R; 242/82

[56] References Cited

U.S. PATENT DOCUMENTS

| | | | |
|---|---|---|---|
| 2,546,557 | 3/1951 | Naegeli | 19/159 R |
| 2,820,255 | 1/1958 | Kaiser | 19/159 R |
| 3,345,702 | 10/1967 | Miedler et al. | 19/159 R |
| 4,173,057 | 11/1979 | Vignon | 19/159 R |

FOREIGN PATENT DOCUMENTS

| | | | |
|---|---|---|---|
| 1280105 | 10/1968 | Fed. Rep. of Germany | 19/159 R |
| 2452310 | 5/1976 | Fed. Rep. of Germany | 19/159 R |
| 2824652 | 1/1979 | Fed. Rep. of Germany | 19/159 R |
| 619738 | 4/1961 | Italy | 19/159 R |

*Primary Examiner*—Louis Rimrodt

*Attorney, Agent, or Firm*—Larson, Taylor and Hinds

[57] ABSTRACT

The apparatus is usable with a funnel wheel and a tube which undergoes tumbling movements for receiving a rope-like strand of fibers from a card or drawing frame and piling the strand of fibers in cycloidal loops in a ramp, through which the rope-like strand is moved to be loaded into cans, typically known as spinning cans. The ramp may be tubular, and may be vibrated. The ramp leads to a first support which is provided with clamps for holding a can. The first support is tiltable, and means are provided for severing the rope-like strand between the ramp and the can when the can is filled to a predetermined extent. A tiltable twin support is provided with clamps for receiving and holding a filled can from the first support, and for receiving, holding and transferring to the first support an empty can to be filled. The twin support can be tilted and moved transversely for receiving a loaded can from the first can support and transferring an empty can to the first support. The twin support can also be tilted to an upright position for transferring a filled can to a first conveyor belt and receiving an empty can from a second conveyor belt. Conventional mechanisms, such as pneumatic actuators, may be used to effect the various movements.

7 Claims, 4 Drawing Figures

APPARATUS FOR LOADING A ROPE-LIKE STRAND OF FIBERS INTO SPINNING CANS

FIELD OF THE INVENTION

This invention relates to apparatus for loading a rope-like strand of fibers into spinning cans after leaving a card or drawing frame and being piled in cycloidal loops in a ramp by a tube describing a tumbling movement. A device of this type for receiving sliver has been described in, for example, Swiss Application No. 8569/77, now Swiss Pat. No. 611,239, corresponding to commonly assigned U.S. Application Ser. No. 920,822, filed June 30 1978 now U.S. Pat. No. 4,173,057, issued Nov. 6, 1979.

BACKGROUND AND SUMMARY OF THE INVENTION

The object of the invention is to provide a device or apparatus for loading the sliver thus piled in the ramp into spinning cans sequentially and efficiently, without having to stop the spinning frame for replacing full cans with empty ones.

Apparatus in accordance with the invention includes a ramp followed by a tiltable support for positioning the can to be filled with its mouth adjacent the end of the ramp, so that the rope-like strand moves progressively along the ramp and into the can. The can is releasably held on the support, and the support is tiltable to various positions at angles to the horizontal, being preferably tilted downwardly progressively as the can is filled. Means are provided for severing the sliver between the ramp and the can. Advantageously, a further twin support is provided for holding a full can and an empty can, the twin support being displaceable at right angles to the longitudinal axis of the ramp, and tiltable between a position at an angle to the horizontal and an upright position. The arrangement is such that the twin support, initially releasably carrying an empty can, can be tilted into position to receive a full can from the first support, then shifted to transfer the empty can to the first support, then tilted upwardly to transfer the full can to a first conveyor and receive a further empty can from a second conveyor, and then moved back into position for a repeat operation when the first mentioned empty can is filled with the sliver.

The ramp may be tubular, and may be provided with a vibratory motion by mechanical, hydraulic or electrical means so as to facilitate sliding of the rope-like strand down the ramp between the tumbling tube and the can being filled.

The basic advantage of the device of this invention is that efficiency is boosted considerably, particularly when relatively small cans are employed as in open-end spinning.

Conventional actuators, such as pneumatic actuators, and control means may be used to effect the various movements of the supports, severing devices, etc. during a complete cycle.

Other and further objects, advantages and features of the invention will become apparent to those skilled in the art from the ensuing description of preferred embodiments, taken in conjunction with the appended drawings.

DESCRIPTION OF A PREFERRED EMBODIMENT

Figure 1:
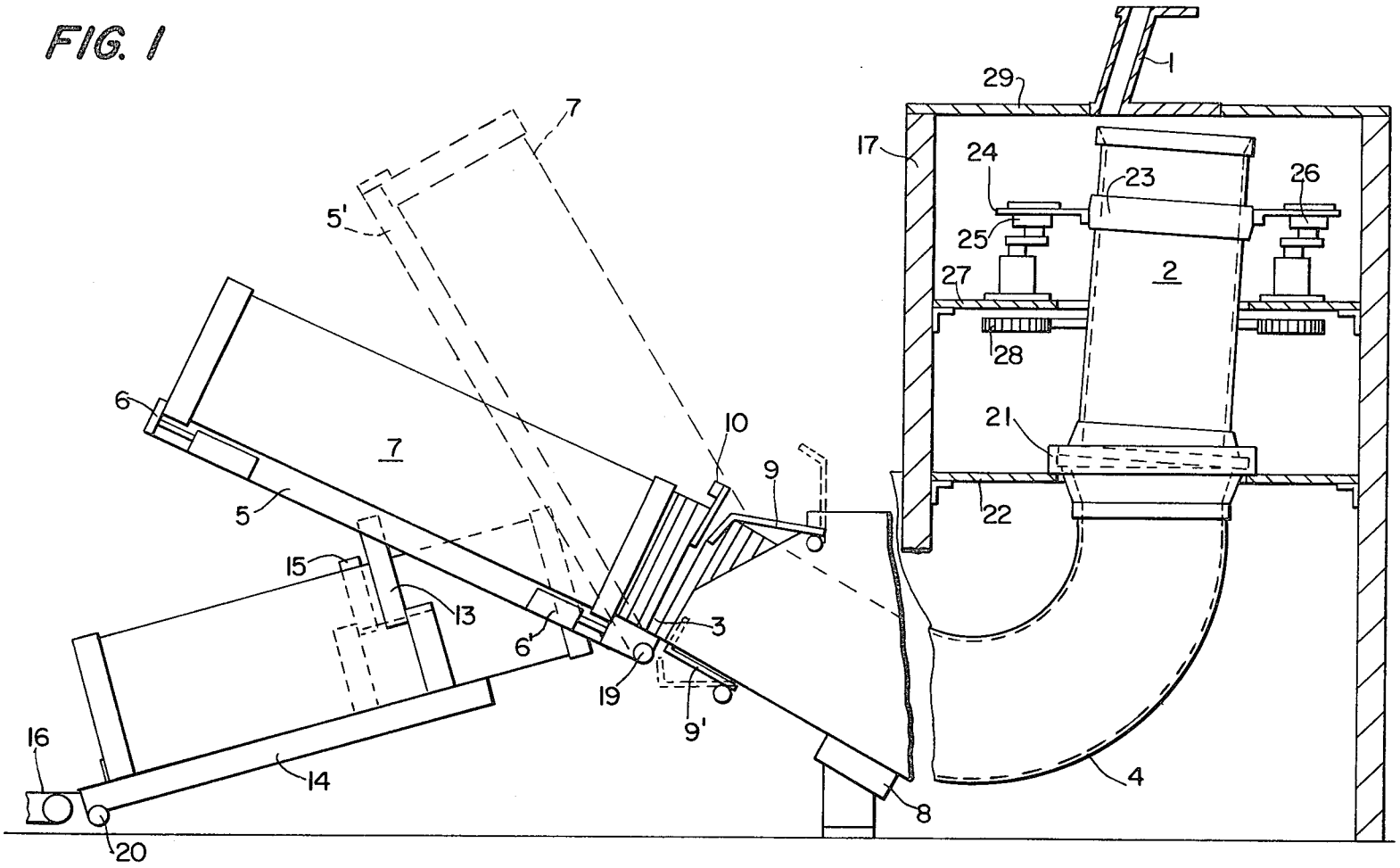
FIG. 1 is a schematic side elevation of apparatus embodying the invention, shown in combination with the apparatus for receiving sliver and piling it in cycloidal loops in a ramp via a tube describing a tumbling movement.

The apparatus illustrated in FIG. 1 for loading the sliver includes a tube 2, which effects a tumbling movement and is positioned in the machine frame 17 at an angle to the horizontal. The lower end of tube 2 is supported in a cylindrical ring 21 located in the bearing plate 22, which has a central opening. The upper part of the tube 2 is supported in a ball bearing 23 whose outer race is located in a matching opening in plate 24. Plate 24 is provided with connections on opposite sides that couple with the ends of crankshafts 25 and 26. The other ends of the crankshafts 25 and 26 are supported in bearing plate 27 mounted on the machine frame 17, so as to be driven by the cog-belt drive 28. Mounted on the machine frame 17 immediately above the top edge of the tube 2 is a further bearing plate 29 with a perforation in which a conventional funnel wheel 1 is located so that it is able to rotate, as is well known.

After leaving the card or drawing frame, the sliver (not shown) is piled by the funnel wheel 1 into the tube 2, the tube 2 being driven in a tumbling movement by the crankshafts 25 and 26, thereby forming a rope-like strand of fibers 3, which is guided down the ramp 4 and fed to the can 7, which is held by clamps 6, 6′ on the support 5. The support 5 is tiltable about tilt axis 19, and its orientation is controlled by, for instance, conventional pneumatic actuators (not shown).

To facilitate movement of the rope-like strand slideably down the ramp 4 without difficulty, the ramp may be caused to vibrate by a device schematically indicated at 8, which may be mechanical, electro-mechanical, etc. As the can 7 is progressively filled with the rope-like strand, the support 5 moves down slowly from the top position 5′ to the waiting position 5, thus tending to maintain constant the pressure of the rope-like strand of fibers on the rapidly rotating funnel wheel 1.

As soon as the amount filled into the can 7 achieves a predetermined amount, which may be sensed by a preselected setting on a counter, a signal is transmitted to initiate a can change, it being understood, however, that this could be controlled either by an operator or automatically. The various operational movements of the parts of the apparatus can be effected by pneumatic actuators (not shown), which in turn may be controlled by pneumatic logic elements (not shown). These components and features may be considered conventional in so far as the invention is concerned. Numerous appropriate arrangements will be readily apparent to those skilled in the art, and hence are not illustrated here.

Figure 2:
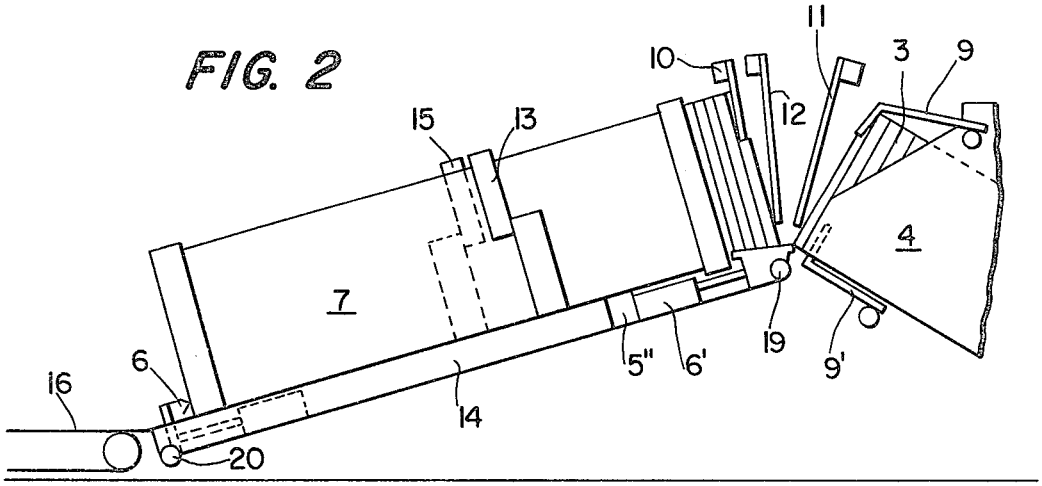
FIGS. 2 and 3 are side elevations of part of the apparatus illustrated in FIG. 1, in respectively different operating positions.

To initiate the can changing operation, cutters or separators 9, 9′ and 10 are swung into the rope-like strand of fibers 3, with the support 5 being tilted to its bottom position 5″ (FIG. 2), thereby opening the rope-like strand of fibers for a clean cut with sword-shaped blades 11 and 12. Advantageously, the drive for swinging cutters 9, 9′ and 10 into the rope-like strand of fibers may be coupled with the drive elements which control the tilt position of support 5 such that the swinging of cutters 9, 9' and 10 into their operative positions causes the support 5 to assume its bottom position 5'' at a much faster rate. This is not, however, essential to the invention itself.

Figure 3:
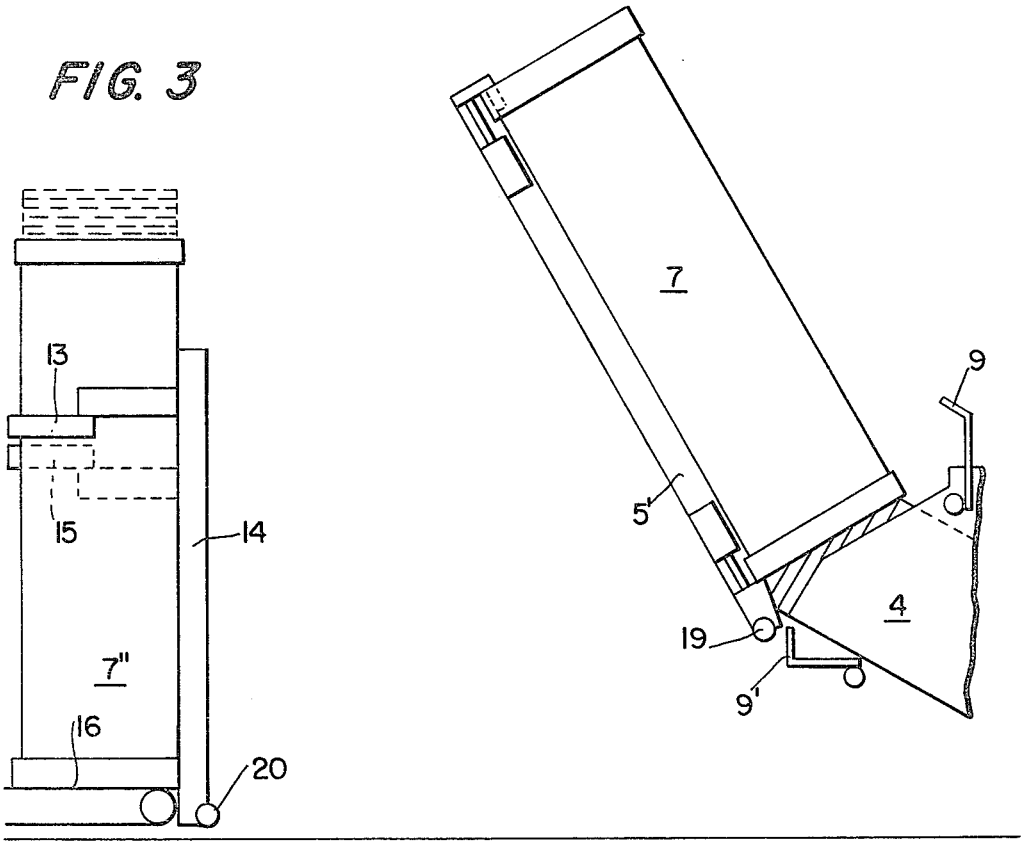
Figure 4:
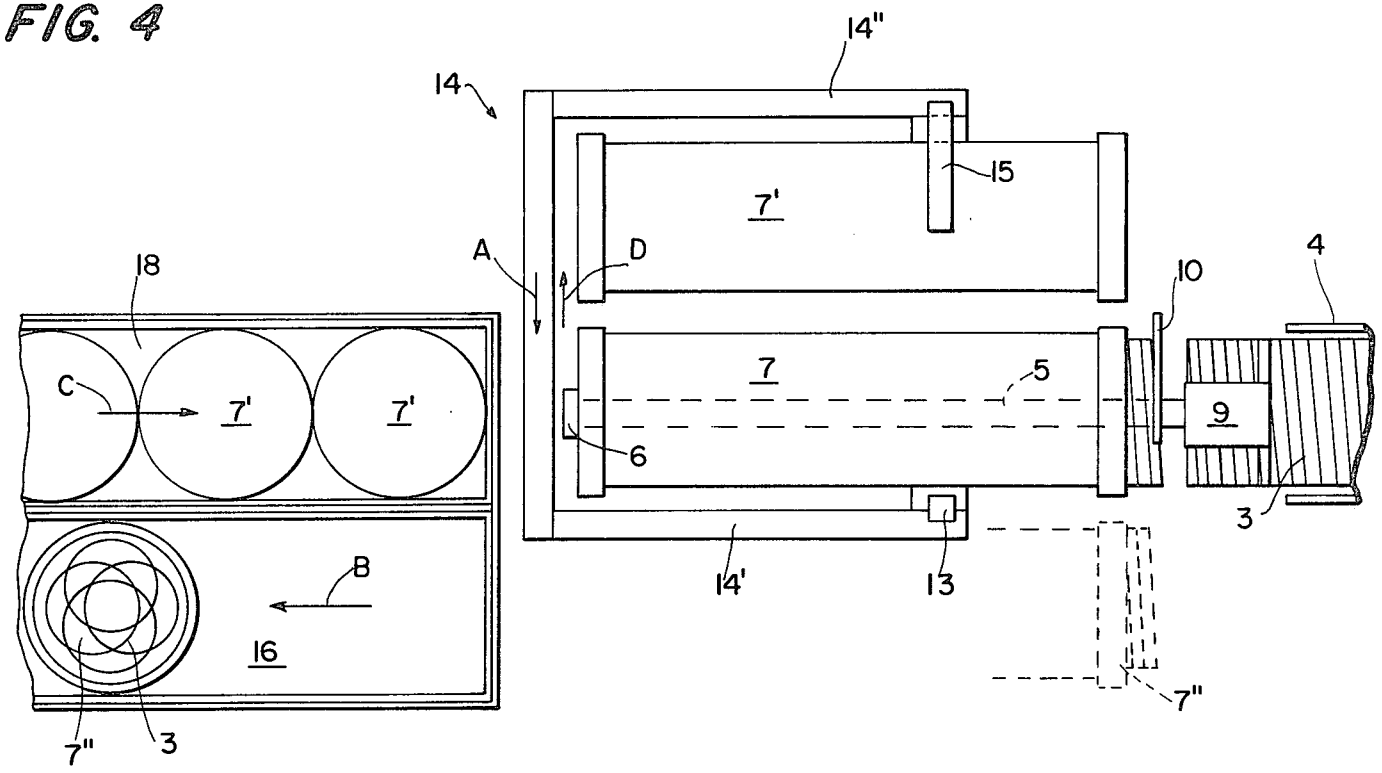
FIG. 4 is a plan view of the apparatus shown in FIGS. 2 and 3.

As shown in FIG. 4, there is also a twin support 14, tiltable about its own axis 20 (FIGS. 1–3), incorporating an arm 14' having a clamp 13, and another arm 14'' having a clamp 15, the clamp 15 gripping an empty can 7' (FIGS. 1 and 4). Twin support 14 is transversely displaceable in the direction of arrows A and D. Clamps 13 and 15 are releasable. In the full line position of twin support 14 as illustrated in FIG. 4, by closing clamp 13 and opening clamps 6, 6' mounted on support 5, the full can 7'' (FIGS. 2 and 4) is released by support 5 and taken by twin support 14. By lateral displacement of the twin support 14 in the direction of arrow A, the full can 7'' is removed to the broken line position shown in FIG. 4, and the empty can 7' is moved into the area of ramp 4 above support 5. By closing clamps 6, 6' of support 5 and releasing clamp 15 on twin support arm 14'', the empty can is taken by support 5 for subsequent filling.

As shown in FIG. 3, the support 5 holding empty can 7' is moved to the top position 5' (FIG. 1), and the blade 11 and cutters 9, 9' are returned to their original positions, thereby releasing the rope-like strand of fibers 3 after its retention, and allowing it to slide into the can to be filled. At the same time, the twin support 14 holding full can 7'' is tilted into its upright position, with the can 7'' being placed on conveyor belt 16, and released by clamp 13. This may be accomplished automatically simultaneously with withdrawal of blade 12 to its original position. Conveyor belt 16 moves in the direction of arrow B, taking the full can 7'' with it. At the same time, the adjacent conveyor belt 18 moves an empty can 7' to the twin support 14 where it is secured by closing clamp 15 on the supporting arm 14''. Following this operation, the twin support 14 is returned to its original position in the direction of arrow D, and tilted to the position shown in FIG. 1, ready for another operational sequence.

The details of the pneumatic actuator elements, control mechanisms, cutters and separators, severing blades, and the like, form no part of the invention itself, and suitable such elements may be appropriately adapted by those skilled in the art.

Having thus described an embodiment of my invention in the manner required by the patent statutes, I claim:

1. An apparatus for loading a rope-like strand of fibers into spinning cans after leaving a card or drawing frame and being piled in cycloidal loops in a tubular member, the improvement comprising a ramp for receiving said rope-like strand and oriented such that the strand is slideable through the ramp to a discharge end thereof, a can support located adjacent the discharge end of said ramp for releasably supporting a can with an open end positioned to receive the rope-like strand from the discharge end of said ramp, means for tilting said can support about a tilt axis located adjacent the discharge end of said ramp to a number of positions at angles to the horizontal such that the can supported thereon can be progressively oriented at different angles in a vertical plane prior to, during and after filling, and means for severing the rope-like strand between the discharge end of said ramp and the open end of said can.

2. Apparatus as claimed in claim 1, further including a twin can support for releasably holding an empty can and a full can transversely adjacent each other, means mounting said twin support for tilting movement between an upright position and a position at an angle to the horizontal, and for displacement transversely to the longitudinal axis of said ramp, such that said twin support can be selectively located and oriented to receive a full can from said can support, to deposit an empty can on said can support, to unload the full can, and to receive a further empty can.

3. Apparatus as claimed in claim 2, wherein said twin support includes releasable clamps for separately and releasably holding an empty can and a full can thereon.

4. Apparatus as claimed in claim 2, wherein said twin support, when in its upright position, is located adjacent first and second conveyors which respectively move toward and away therefrom for bringing empty cans thereto and removing full cans therefrom.

5. Apparatus as claimed in claim 2, wherein said can support tilts progressively downwardly during filling from an upwardly oriented top position to a can transfer position in which it can transfer a full can to, and receive an empty can from, said twin support upon transverse placement of said twin support.

6. Apparatus as claimed in claim 1, further including means for vibrating said ramp to facilitate sliding movement of said rope-like strand therethrough.

7. Apparatus as claimed in claim 1, wherein said ramp is tubular.

* * * * *